US005586417A

United States Patent [19]

Henderson et al.

[11] Patent Number: 5,586,417

[45] Date of Patent: Dec. 24, 1996

[54] TENSIONLESS PIER FOUNDATION

[76] Inventors: Allan P. Henderson, 5919 Mohawk Dr., Bakersfield, Calif. 93308; Miller B. Patrick, 5808 Baywood, Bakersfield, Calif. 93309

[21] Appl. No.: 346,935

[22] Filed: Nov. 23, 1994

[51] Int. Cl.[6] ..... E02D 5/38; E02D 27/32

[52] U.S. Cl. ..... 52/295; 52/223.4; 52/741.15; 52/742.14; 405/233; 405/236; 405/239; 405/249

[58] Field of Search ..... 52/294, 295, 296, 52/741.11, 741.14, 741.15, 742.14, 223.4, 223.5; 405/229, 232, 233, 236, 237, 238, 239, 242, 249

[56] References Cited

U.S. PATENT DOCUMENTS

| | | | |
|---|---|---|---|
| 274,261 | 11/1895 | Rensaa . | |
| 1,048,993 | 12/1912 | Meriwether | 405/239 X |
| 2,374,624 | 4/1945 | Schwendt . | |
| 2,706,498 | 4/1955 | Upson . | |
| 3,186,181 | 6/1965 | Snow et al. | 405/233 |
| 3,382,680 | 5/1968 | Takano | 52/223.5 X |
| 3,559,412 | 2/1971 | Fuller | 405/237 |
| 3,600,865 | 8/1971 | Vanich . | |
| 3,839,874 | 10/1974 | Wyant | 405/233 |
| 3,842,608 | 10/1974 | Turzillo | 405/236 |
| 3,963,056 | 6/1976 | Shibuya et al. | 138/175 |
| 3,963,065 | 6/1976 | Dauwalder . | |
| 4,228,627 | 10/1980 | O'Neill | 52/295 |
| 4,287,691 | 9/1981 | Gueuther | 52/294 X |
| 4,618,287 | 10/1986 | Kinnan | 52/296 X |
| 4,842,447 | 6/1989 | Lin | 405/233 X |
| 5,228,806 | 7/1993 | De Medieros, Jr. et al. | 405/232 X |
| 5,379,563 | 1/1995 | Tinsley | 52/295 |

*Primary Examiner*—Wynn E. Wood
*Assistant Examiner*—Kevin D. Wilkens
*Attorney, Agent, or Firm*—Jacobson, Price, Holman & Stern, PLLC

[57] ABSTRACT

A hollow, cylindrical pier foundation is constructed of cementitious material poured in situ between inner and outer cylindrical corrugated metal pipe shells. The foundation is formed within a ground pit and externally and internally back filled. The lower end of the foundation has a circumferential ring fully embedded therein and sets of inner and outer circumferentially spaced bolts have their lower ends anchored to the anchor ring, their upper ends projecting up outwardly of the top of the foundation and a majority of the midportions thereof free of connection with the cementitious material of which the foundation is constructed. The base flange of a tubular tower is positioned downwardly upon the upper end of the foundation with the upper ends of the inner and outer sets of bolts projecting upwardly through holes provided therefor in the base flange and nuts are threaded downwardly upon the upper ends of the bolts and against the base flange. The nuts are highly torqued in order to place the bolts in heavy tension and to thus place substantially the entire length of the cylindrical foundation in heavy axial compression.

13 Claims, 4 Drawing Sheets

TENSIONLESS PIER FOUNDATION

BACKGROUND OF THE INVENTION

1. Field of the Invention

This invention relates to concrete foundations particularly useful for the support of tall, heavy and or large towers which may be used to support power lines, street lighting and signals, bridge supports, wind turbines, commercial signs, freeway signs, ski lifts and the like.

2. Description of Related Art in Relation to Present Invention

Various different forms of foundations utilizing some of the general structural and operational features of the instant invention heretofore have been known, such as those disclosed in U.S. Pat. Nos. 2,374,624, 2,706,498, 2,724,261, 3,600,865 and 3,963,056. However, these previously known foundations do not include some of the basic features of the instant invention, and the combination of features incorporated in the instant invention enable a heavy duty foundation with a slenderness ratio of less than 3 to be formed in situ and in a manner not requiring the use of large drilling rigs or pile drivers. The combination comprising the present invention results in a foundation capable of resisting very high upset loads in various types of soils and in a manner independent of the concrete of the foundation experiencing alternating localized compression and tension loading.

U.S. Pat. No. 2,374,624 to P. J. Schwendt discloses a foundation intended for supporting signal masts, supply cases and signals. The foundation consists of pre-cast sections of concrete bolted together. The composite foundation is embedded in soil. The mounting of a tall mast section for signals on this foundation would subject the foundation to some overturning moment, and the Schwendt foundation is only applicable to relatively small structures, inasmuch as it is constructed from pre-cast sections which necessarily impose size limitations on the foundation and therefore the structure supported thereon.

In comparison, the pier foundation of the instant invention is poured-on-site monolithically and is of cylindrical construction with many post-tensioned anchor bolts which maintain the poured portion of the foundation under heavy compression, even during periods when the foundation may be subject to high overturning moment.

U.S. Pat. No. 2,706,498 to M. M. Upson discloses a pre-stressed tubular concrete structure particularly adapted for use as pipe conduits, concrete piles and caissons. The pre-stressed tubular concrete structure is pre-cast in sections and can be assembled end-to-end. Longitudinal reinforcing steel is provided and extends through cavities, is tensioned and grouted tight, therefore pre-stressing helical wire windings which are tensioned providing circumferential pre-stressing. The Upson structure is pre-stressed and not of a size diameter suitable as a foundation for tall support towers or columns subject to high upset moment and would be very difficult to transport to a remote area of use.

In contrast, the foundation of the instant invention is poured on site monolithically and, therefore, in the case of a remote point of use, needs only transportation for the ingredients of concrete, corrugated pipe sections and tension bolts to the construction location and only to the extent necessary to construct the foundation in accordance with the present invention.

U.S. Pat. No. 2,724,261 to E. M. Rensaa discloses a pre-cast column and means for attaching the column to a substantially horizontal supporting surface such as a footing or wall and which is otherwise not suitable for use as a large or tall tower foundation.

U.S. Pat. No. 3,600,865 to Francesco Vanich discloses a single column-borne elevated house unit erected by assembling, on a cast in situ foundation pillar, column sections provided with means for fastening the same together and to the foundation pillar above the pillar and by also fastening to the column sections radially arranged cantilever beams. The assembled parts are fastened together and to the foundation pillar by tendon sections which are first coupled together by joints, and then tensioned and eventually bonded to the concrete of the assembled parts by forcing grout in the clearance fully around the tendon rods.

The Vanich house foundation is supported either on a large diameter pile cast or otherwise forced into the ground or inserted with its base portion into a small diameter pit whose peripheral walls and bottom are coated with a thick layer of preferably reinforced concrete. Sheathed steel rods are placed into the pit which is then filled with concrete. Before the concrete is completely hardened, a light prefabricated base is fitted thereon with screw threaded rods extending through the base.

U.S. Pat. No. 3,963,056, to Shibuya et al. discloses piles, poles or like pillars comprising cylindrical pre-stressed concrete tubes or pillar shaped pre-stressed concrete poles with an outer shell of steel pipe. While inclusion of the outer steel pipe as the outer shell increases the compressive strength of the concrete tube or pole by preventing the generation of lateral stress within the concrete tube or pole in a radial direction, the outer steel shell provides little resistance to tension stresses imposed upon the concrete due to swaying or side-to-side movement of tall towers supported on the foundation. In contrast, the pier foundation of the instant invention is post-stressed sufficiently to place the entire vertical extent of the concrete portion of the foundation under compression which considerably exceeds any expected tension loading thereof.

Finally, U.S. Pat. No. 1,048,993, to C. Meriwether discloses a reinforced concrete caisson which can be sunk in the usual way. Then, if desired, the caisson may be filled with concrete to form a pier. The reinforced concrete caisson is pre-cast into tubular sections of concrete with heavy large-mesh fabric of wire reinforcement and metal rings embedded at the ends for bolting sections together at a bell and spigot joint. Tie-rods extend through the connecting rings on the inside of the reinforced concrete tube to connect the section together. However, the tensioned tie-rods of Meriwether are spaced inward of the inner peripheries of the concrete tubes and do not pass through the thick wall concrete construction itself.

SUMMARY OF THE INVENTION

The foundation of the instant invention is unique because it eliminates the necessity for reinforcing steel bars (rebar tension bars), substantially reduces the amount of concrete used, and therefore the cost of the foundation compared to conventional designs, simplifies the placement of the supported structure on the foundation, and eliminates alternating cyclical compression and tension loading on the foundation, thereby substantially reducing fatigue. Also, the foundation construction of the present invention allows for the replacement of the tower anchor bolts in the unlikely event of bolt failure.

In a normal concrete pier foundation the concrete bears the compressive loads and the contained reinforcing bars (rebar) bear the tensile loads. The anchor bolts are typically placed within the reinforcing bar matrix using a removable template at the top and a separate anchor plate at the bottom of each bolt. The entire module is poured in concrete. As the foundation is loaded by the structure supported therefrom, the unit is subjected to varying tensile and compressive loads with there being a boundary at the bolt anchor plates where the loading on the concrete alternates from a compressive load to a tensile load depending upon the various forces on the supported structure. The tensile load from the overturning moment of the supported structure is applied near the top of the foundation by the anchor bolts and subjects the large portion of the foundation below the point of application to tension. The large foundation typically requires a great amount of reinforcing steel and a large amount of concrete to encase the reinforcing steel. Extensive labor is also necessary to assemble the reinforcing steel matrix and fill the volume of the foundation with concrete and fix the anchor bolts. A typical cylindrical foundation also requires the use of a large drill to excavate the hole.

The foundation of the instant invention is a concrete cylinder. The outer boundary shell of the concrete is formed by corrugated metal pipe. The inner boundary, preferably in large hollow cylinder foundations, is also formed by corrugated metal pipe of lesser diameter. Elongated high strength steel bolts then run from an anchor flange near the bottom of the cylinder vertically up through "hollow tubes" extending vertically through the concrete portion of the foundation to a connecting flange of the supported structure. The bolt pattern is determined by the bolt pattern on the mounting flange of the supported structure. That pattern is established in the construction of the foundation by a removable template. The "hollow tubes" are preferably in long plastic tubes which encase the bolts substantially through the entire vertical extent of the concrete and allow the bolts to be tensioned thereby post-tensioning the entire concrete foundation. Alternatively, the elongated bolts can be wrapped in plastic tape, or coated with a suitable lubrication, which will allow the bolts to stretch under tension over the entire operating length of the bolt through the vertical extent of the concrete. There is no typical rebar reinforcing steel in the foundation, except perhaps in large foundations where a small amount of incidental steel may be used to stabilize the bolts during construction. The costs of the elongated bolts and nuts is significantly less than the cost of reinforcing steel, the placement of the steel and necessary anchor bolts associated with conventional foundations.

The center of a large hollow cylindrical foundation is filed with excavated soil and then capped. Excavation for the foundation may be done using widely available, fast, low cost excavating machines instead of relatively rare, slow, costly drills necessary for conventional cylindrical foundations.

The design of the foundation of the instant invention uses the mechanical interaction with the earth to prevent over turning instead of the mass of the foundation typically used by other foundations for tubular towers. The foundation of the instant invention thus greatly reduces the costs by eliminating the need to fabricate reinforcing steel matrices and to locate and connect the anchor bolts within the reinforcing bar matrix, and by reducing the amount of concrete required and excess excavating costs such as those required for typical cylindrical foundations.

When the structure to be supported by the foundation is placed thereon, the bolts are tightened to provide tension on the bolts from the structure flange to the anchor plate at the bottom of the foundation, thereby post-stressing the concrete in great compression. The bolts are tightened so as to exceed the maximum expected overturning force of the tower structure on the foundation. Therefore, the entire foundation withstands the various loads with the concrete thereof always in compression and the bolts always in static tension. In contrast, conventional foundations, in which the bolt pattern is set in concrete in a reinforcing bar matrix, experience alternating tensile and compressive loads on the foundation concrete, reinforcing bars and anchor bolts, thereby producing loci for failure.

The main object of this invention is to provide a pier foundation which will exert maximum resistance to upset.

Another object of this invention is to provide a concrete pier foundation which is maintained under heavy compression considerably in excess of expected tension forces when resisting upset of a supported tower, especially tall towers and structures.

Another important object of this invention is to provide a concrete pier foundation which may be formed in situ in remote locations.

A still further object of this invention is to provide a pier foundation in which the concrete is heavily post-stressed in the vertical direction to thereby stabilize tension and compression forces.

Another object in conjunction with the foregoing objects is to post-stress the concrete in a manner which avoids formation of failure loci at the upper surface of the concrete where the supported structure is attached.

A further object of this invention is to provide a pier foundation which may be formed in remote locations independent of the use of heavy drilling or pile driving equipment.

Still another important object of this invention is to provide a pier foundation which may be formed in situ independent of the use of reinforcing materials.

Another object of this invention is to provide a pier foundation whose components may be trucked to remote locations without excessive difficulty.

A further important object of this invention is to provide a pier foundation which is not restricted by soil conditions or ground water.

Still another object of this invention is to provide a pier foundation which will incorporate a minimum amount of concrete.

A further important object of this invention is to provide a pier foundation which may be readily adaptable to a pedestal configuration for elevation of the associated tower above high water level in flood zones.

Yet a further object of this invention is to provide a pier foundation that is resistant to erosion, scouring and sedimentation.

Another object of this invention is to provide a pier foundation which may be constructed to include a hollow upper portion for containment of equipment associated with the corresponding tower such as switch gear, transformers, etc. secure from the elements and vandalism.

Yet another important object of this invention is to provide a pier foundation including tensioned compression bolts incorporated into the foundation in a manner such that they may be periodically retorqued and substantially fully removed from the bores in which they are received in the event it becomes necessary to remove the foundation, in which instance the bolt receiving bores may be used as chambers to contain blasting material.

A final object of this invention to be specifically enumerated herein is to provide a pier foundation in accordance with the preceding objects and which will conform to conventional forms of manufacture, be of simple construction and easy to erect so as to provide a structure that will be economically feasible, long lasting and relatively inexpensive.

These together with other objects and advantages which will become subsequentially apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
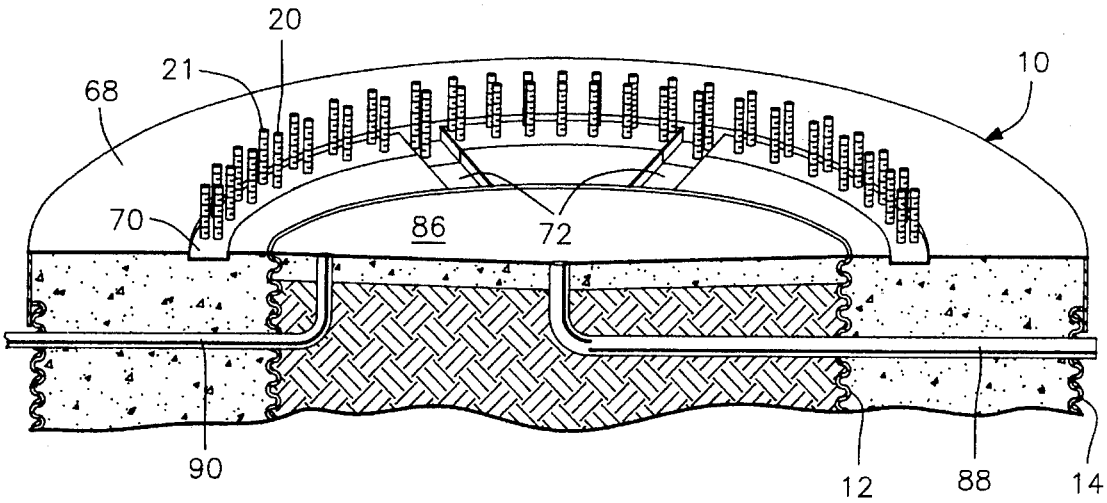
FIG. 1 is a fragmentary vertical sectional view of the upper portion of a completed pier foundation constructed in accordance with the preferred embodiment of the present invention and ready to have the base of a tower to be supported therefrom anchored to the foundation and utilized, in conjunction with tension bolts, to place the pier foundation in heavy compression.
Figure 2:
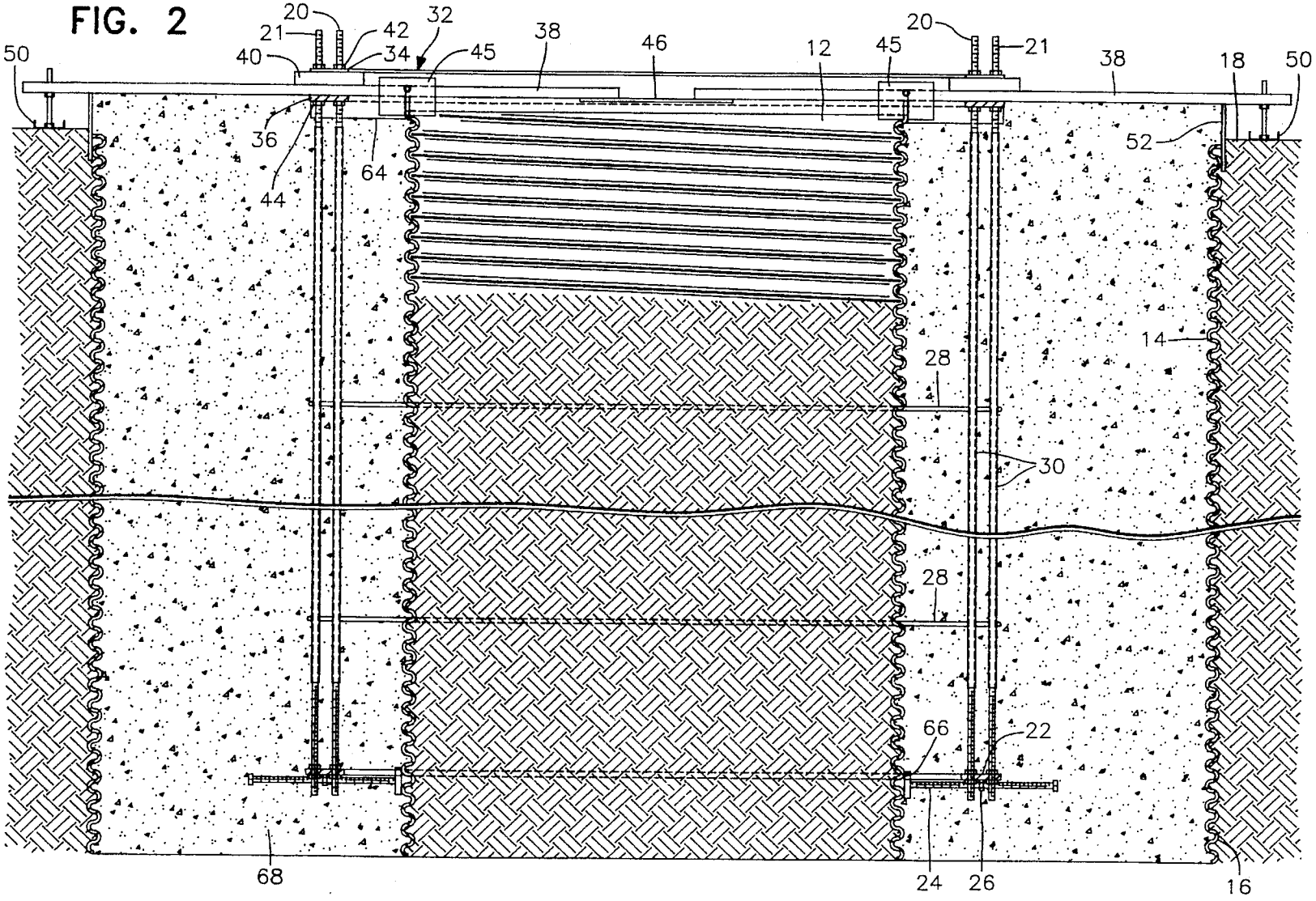
FIG. 2 is a fragmentary vertical sectional view illustrating the pier foundation of FIG. 1 immediately after pouring of the concrete thereof.
Figure 3:
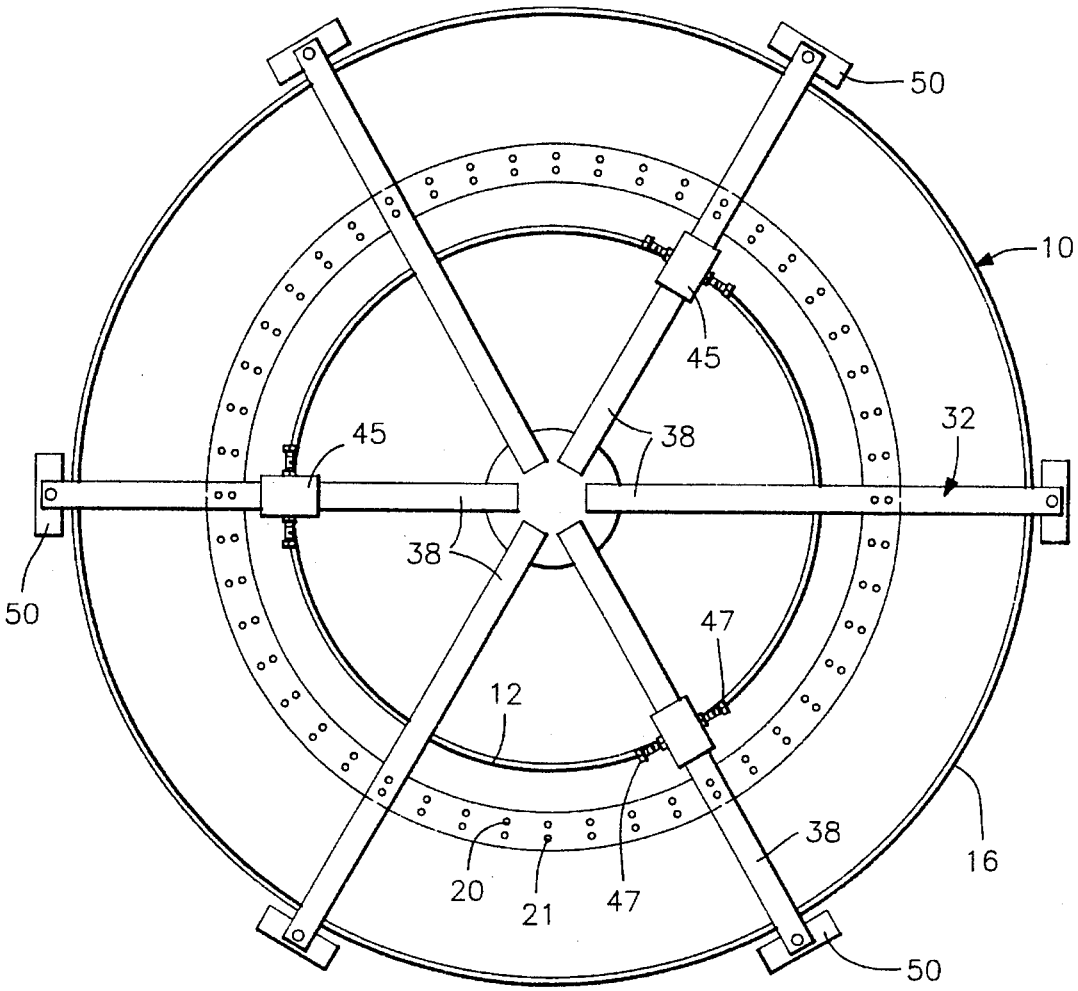
FIG. 3 is a top plan view of the assemblage illustrated in FIG. 2.

Referring now more specifically to the drawings, especially FIGS. 1 and 2, the numeral 10 generally designates the pier foundation of the instant invention. The foundation 10 preferably includes inner and outer upstanding corrugated pipe sections 12 and 14 which may, for example, be ten feet and eighteen feet, respectively, in diameter and generally twenty feet in length. The outer pipe 14 is initially placed within a hole or excavation 16 formed in the ground 18 and resting upon the bottom of the excavation 16. The inner corrugated pipe is then placed and positioned within the excavation 16 and the interior of the inner corrugated pipe 12 is partially back filled and the excavation 16 outwardly of the outer corrugated pipe 14 being initially partially back filled to stabilize the pipe sections generally in position within the excavation and relative to each other.

The foundation 10 additionally includes a series of tensioning bolts 20 and 21 spaced circumferentially about the annulus defined between pipe sections 12 and 14. Preferably, the tensioning bolts are in side-by-side pairs which extend radially from the center of the foundation. The inner ring of bolts 20 has a slightly shorter diameter than the outer ring of bolts 21. In the embodiment shown with the dimensions described in the preceding paragraph forty-eight tensioning bolts 20 and forty-eight tensioning bolts 21, or a total of ninety-six, are provided. The rings of bolts have diameters which are several inches apart and diameters generally about 12 feet. However, it will be understood by those skilled in the art that the number of tensioning bolts and their circumferential positioning will depend upon the number and position of the holes of the anchoring feet of the tower or other structure to be supported on the foundation.

The lower ends of the bolts 20 and 21 are anchored relative to a lower anchor ring 22, which preferably may be constructed of several circumferentially butted and joined sections, and the anchor ring 22 is radially spaced relative to the inner corrugated pipe 12 preferably by utilization of circumferentially spaced horizonal and radially extending positioning bolts 24 threaded through nuts 26 secured relative to the under side of the anchor ring 22 at points spaced circumferentially thereabout. Further, the bolts 20 and 21 have all but their opposite ends slidingly received through hollow tubes, preferably PVC pipes which are sized to receive and loosely grip to bolts 20 and 21 but still permit free movement therethrough. As shown in the drawings, the hollow tubes or PVC tubing need not extend through the entire vertical height of concrete 68, only through as much of the central portions and extending as close to the top and bottom as to allow tensioning bolts to extend evenly through the concrete during post-tensioning.

In lieu of the PVC pipes 30 and other suitable tubing which may be used or any other suitable method such as a lubricant coating or plastic wrap may be used to prevent bonding between the bolts 20 and 21 and the concrete to be subsequentially poured. It should be understood that tubes 30 serve to allow bolts 20 and 21 to move relatively freely through the concrete after curing so as to allow post-tensioning of the elongated rods. Any mechanism which allows the movement for post-tensioning is contemplated for this invention. In addition, rebar wraps 28 are preferably used and secured to the tubes 30 associated with outer bolts 21 at approximately five foot intervals along the vertical extent of the bolts 21 in order to maintain the bolts longitudinally straight during the pour of concrete.

The upper ends of the bolts 20 are supported from a template referred to generally by the reference numeral 32 and consisting of upper and lower rings (ring sections secured together) 34 and 36 between which upwardly opening radial channel members 38 and mounting blocks 40 received in the channel members 38 are clamped through the utilization of upper and lower nuts 42 and 44 threaded on the bolts 20 and 21. The inner ends of the radial channel members 38 are joined by a center circular plate 46 and the inner portions of the channel members 38 include lateral stabilizers 45 in the form of inverted channel members downwardly embracingly engaged thereover and equipped with opposite side set screws 47 clamp engaged with the corresponding channel members 38. The depending flanges 49 of the channel members 45 are slotted as at 51 for stabilizing engagement with adjacent upper edge portions of the inner pipe 12 while the outer ends of the channel members 38 include threadingly adjustable channel member feet 50 abutingly engageable with the ground 18.

Figure 6:
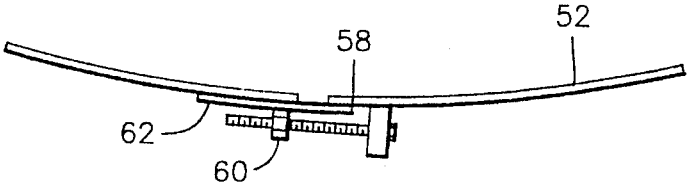
FIG. 6 is a fragmentary enlarged top plan view illustrating the manner in which the opposite ends of the upper peripheral form plate are lap-secured relative to each other.
Figure 7:
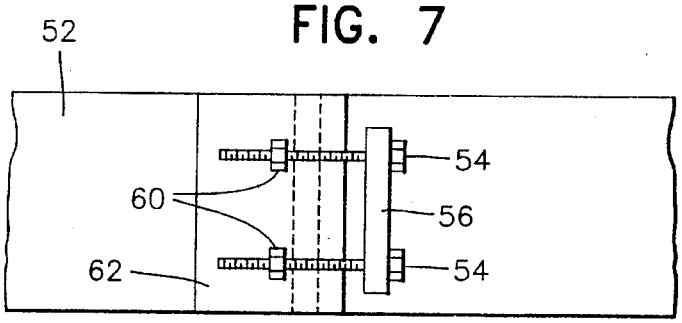
FIG. 7 is an elevational view of the assemblage illustrated in FIG. 6.
Figure 9:
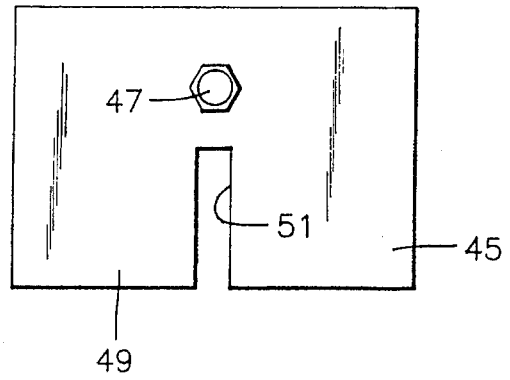
FIG. 9 is a side elevational view of a stabilizer channel for stabilizing the radial channel members, laterally, relative to the inner corrugated pipe.
Figure 10:
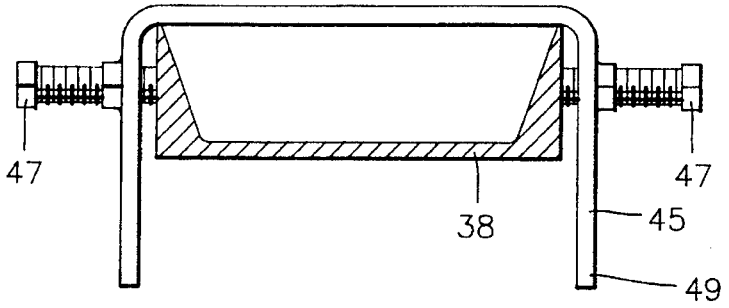
FIG. 10 is a vertical sectional view illustrating the stabilizer channel as mounted on one of the radial channel members.
Figure 11:
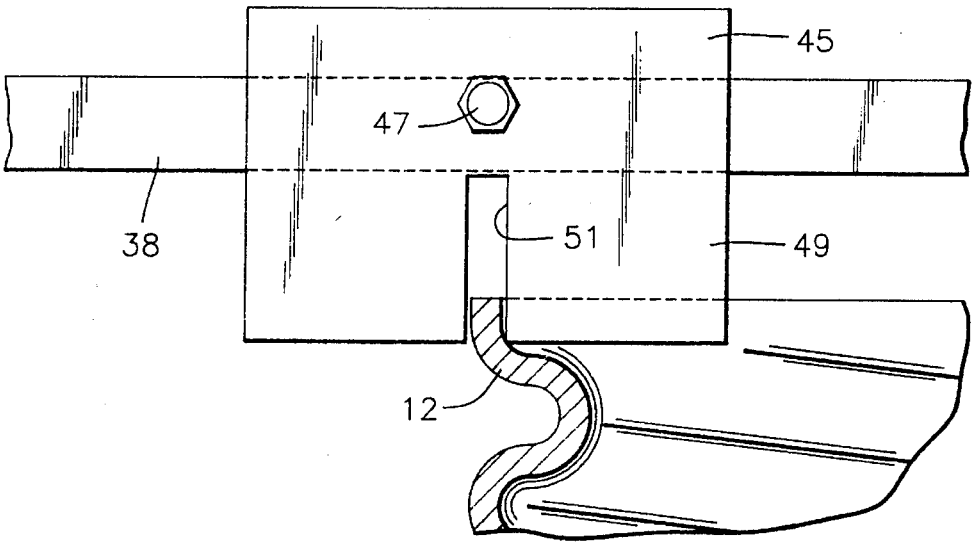
FIG. 11 is a side elevational view of the assembly of FIG. 10 as engaged with an upper edge portion of the inner corrugated pipe, the latter being fragmentarily illustrated in vertical section.

Further, a cylindrical formplate 52 is clamped about the upper end of the outer pipe 14 and has its opposite ends secured together in overlapped relation as illustrated in FIGS. 6 and 7. The form plate ends are joined together by a pair of threaded bolts 54 rotatably received through a mounting lug 56 carried by one end 58 of the form plate 52 and threadedly secured through bolts 60 carried by the other end of the plate 52. A lap plate 62 is carried by the last mentioned form plate end and lapped over the form plate end 58 carrying the mounting lug 56.

Figure 4:
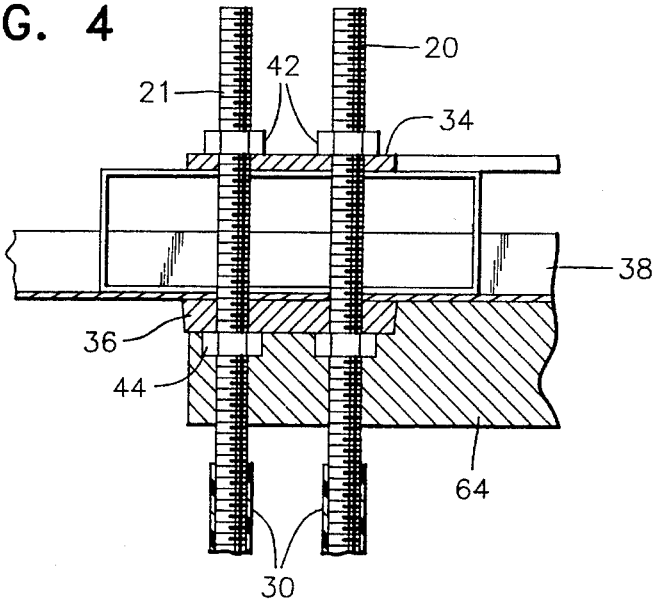
FIG. 4 is an enlarged fragmentary vertical sectional view illustrating the manner in which the upper template is used during the construction of the pier foundation in accordance with the present invention to maintain the upper ends of the tension bolts properly positioned.
Figure 5:
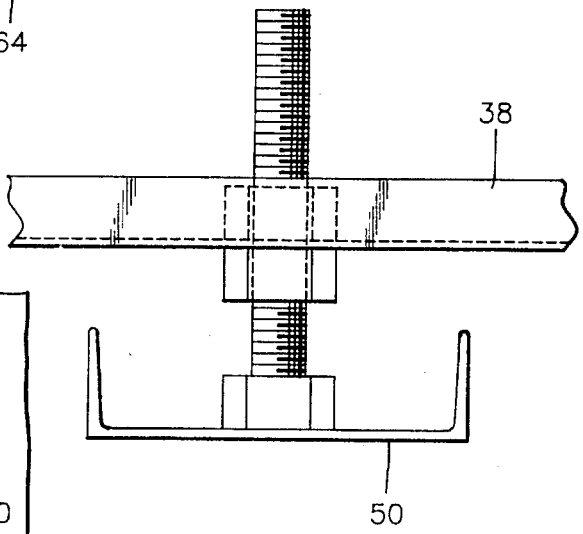
FIG. 5 is a fragmentary enlarged side elevational view of the outer end portion of one of the template radials illustrating the manner in which it may be adjusted relative to ground level outwardly of the outer periphery of the pier foundation.
Figure 8:
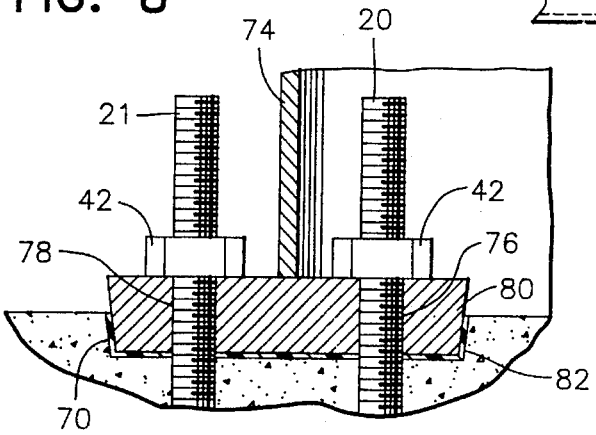
FIG. 8 is an enlarged fragmentary vertical sectional view illustrating the manner in which the tower lower end and base flange may be bolted to the upper end of the pier foundation in accordance with the present invention, while at the same time tensioning the tension bolts and placing the concrete of the foundation under heavy compression.

As may be seen from FIG. 4, the ring 36 is slightly downwardly tapered and at each radial channel member 38 a blockout body 64 is provided for a purpose to be hereinafter more fully described. Further, each of the six radial channel members receive the corresponding pair of inner and outer bolts 20 and 21 therethrough and each of the blockout bodies 64 extends inwardly to the outer periphery of the inner corrugated pipe 12, and encloses the corresponding nuts 44 as may be seen in FIG. 4. Preferably, the blockout bodies 64 are constructed of any suitable readily removable material, such as wood or styrofoam.

After the template 32, the bolts 20 and 21 with their associated tubing 30, wraps 28 if necessary and the lower anchor ring 22 have been assembled, the bolts 24 are adjusted inwardly until the caps 66 carried by the bolt inner ends approximate the outer periphery of the inner pipe 12 with the inner set of bolts 20 generally equally spaced from the inner corrugated pipe 12. A crane is then utilized to lower the assembly down into the space between the inner and outer pipes 12 and 14 after the form plate 52 has been placed in position. Then, the feet 50 are adjusted in order to insure that the template 32 is level.

Thereafter, concrete 68 may be poured to the bottom of each of the radial channel members 38 and to the top of each of the blockout bodies 64. After the concrete 68 has hardened, the upper nuts 42 are removed and the entire template 32 including the upper and lower rings 34 and 36 the channel members 38 and attached feet 50 are lifted up from the bolts 20 and 21 and the form plate 52, the blockout bodies 64 being exposed from above by removal of the template 32 to then allow removal of the blockout bodies 64.

When the concrete 68 has sufficiently hardened and it has been determined that the groove 70 is level, the nuts 44 are removed or threaded downwardly on the bolts 20 and 21 at least ¾ inch and the tower 74 to be supported from the foundation 10 is thereafter lowered into position with the upper exposed ends of the bolts 20 and 21 upwardly received through suitable bores 76 and 78 formed in the inner and outer peripheries of the base flange 80 of the tower 74 and the lower lug defining portion of the base flange 80 seated in the groove 70, a coating of high compression hardenable grout 82 preferably having been placed within the groove 70 prior to positioning of the lower end of the tower 74 downwardly upon the foundation 10. Initially, the upper nuts 42 are again threaded down onto the upper ends of the bolts 20 and 21 and preferably torqued to 50 foot pounds. The nuts 42 are thereafter sequentially torqued (in a predetermined pattern of tightening) preferably to about 600 foot pounds which places each of the bolts 20 and 21 under approximately 40,000 pounds tension at approximately ⅓ the stretch limit of the bolts 20 and 21.

If, on the other hand it has been found, after the concrete has sufficiently hardened, and the blockout bodies 64 have been removed that the groove 70 is not level, the nuts 44 are adjusted to define a level plane co-incident with the highest portion of the groove 70. Then, high strength grout 82 is poured into the groove 70 and the tower 74 is lowered into position seated within the groove 70 on the high side thereof and supported by the nuts 44 at the other locations about the foundation 10, the nuts 42 then being installed and only initially tightened. After the grout 82 has hardened, nuts 42 are sequentially torqued in the same manner as set forth hereinbefore.

By placing the bolts 20 and 21 under high tension, the cylindrical structure comprising the concrete 68 is placed under heavy compressive loading from the upper end thereof downwardly to a level adjacent the lower end of the cylindrical structure and the compressive loading is considerably greater than any upset tensional forces which must be overcome to prevent upset of the tower 74 and foundation 10. As a result, the concrete 68 is always under compression and never subject to alternating compression and tension forces.

As may be seen from FIG. 2, the back fill within the inner pipe 12 may be completed considerably below the surface of the ground 18. In such instance, the interior of the upper portion of the pipe 12 may be used to store maintenance equipment, electrical control equipment or other equipment, in which case the lower end of the tower 74 will be provided with a door opening (not shown).

On the other hand, the back fill within the inner pipe 12 may be completed to substantially ground level and provided with a poured concrete cap 86, as shown in FIG. 1. The cap 86 may be sloped toward the center thereof and provided with a drainage conduit 88 and a conduit 90 for electrical conductors (not shown) also may be incorporated in the foundation 10.

In estimating the cost of completing a foundation constructed in accordance with the present invention and taking into consideration less expensive excavation and back fill costs, the absence of reinforcing steel bars and the use of a smaller volume of concrete, the total cost would be in the neighborhood of $24,000 for a foundation having an outside diameter of fourteen feet, an inside diameter of nine feet and a height of approximately twenty-five feet. On the other hand, the estimate for forming a similar conventional pier foundation is in the neighborhood of $29,000 and the estimate for constructing a mat foundation also suitable for supporting a 150 foot tube tower is approximately $30,000 to $31,000, these figures being exclusive of excessive labor costs. Also, it will be noted that labor and transportation costs are considerably greater for pier and conventional mat foundations, especially if the location of the foundation is remote and access thereto includes portions other than on paved roadways.

It is to be noted that the foundation 10 may be used for supporting many different types of towers, but its reduced cost at remote locations and its resistance to upset independent of alternating compression and tension forces makes it particularly well adaptable for use in supporting windmill towers.

Further, the utilization of corrugated inner and outer pipes 12 and 14 greatly increases the resistance to upset and by utilizing a cylindrical foundation which is hollow and not closed at the bottom of its interior, the back fill within the inner corrugated pipe 12 increases the resistance of the bottom of the foundation to lateral slippage relative to the ground immediately beneath the concrete 68.

The foregoing is considered as illustrative only of the principles of the invention. Further, since numerous other modifications and changes readily will occur to those skilled in the art, it is not desired to limit the invention to the exact construction and operation shown and described, and accordingly, all suitable modifications and equivalents may be resorted to, falling within the scope of the invention.

What is claimed is:

1. A pier foundation subject to high upset forces which comprises a hollow, upright cylindrical structure of heavy post-compressed cementitious material under high compressive loading from the upper end thereof downwardly to a level adjacent the lower end thereof and having open top and bottom ends, a plurality of metal rods and shield means surrounding said rods spaced about said cylindrical structure and extending generally vertically in said cementitious material from said level to said upper end, and tension adjusting structure operatively connected between said rods and said cylindrical structure for tensioning of said rods, said shield means shielding said rods from said cementitious material and permitting said rods to elongate relative to said cementitious material during tensioning, said rods each being heavily tensioned between said level and said upper end to post-compress said cementitious material, and said shield means continuously shielding said rods from said cementitious material to permit said rods to be retenioned as necessary.

2. The pier foundation of claim 1 wherein said cylindrical structure includes longitudinally corrugated inner and outer surfaces conforming to and tightly bound by cylindrical inner and outer metal corrugated pipes.

3. A tensionless pier foundation including a hollow, upright cylindrical structure of post-compressed cementitious material under high compressive loading from the upper end thereof downwardly to a level adjacent the lower end thereof and having open top and bottom ends, said cylindrical structure being adapted to be formed in situ and to be externally as well as internally back filled, said lower end of said structure including an annular anchor ring assembly fully embedded therein, at least one set of upright, circumferentially spaced anchor bolts imbedded in and extending through said cementitious material, having lower ends anchored relative to said anchor ring and upper ends projecting upwardly from said top end of said structure, said anchor bolts being substantially shielded against bonding of said cementitious material thereto at least throughout a major portion of the length thereof between said anchor ring and said top end, said upper ends of said bolts passing upwardly through a heavy annular base flange seated up on the top end of said cylindrical structure, and threaded nuts threaded upon said upper ends above said annular base flange and tightened downwardly thereover sufficiently to place said anchor bolts under heavy tension and thereby place said cylindrical structure under heavy post-compression extending fully about said cylindrical structure in excess of maximum upset moment forces expected to be exerted on said foundation by an upright tower mounted from said flange.

4. The pier foundation of claim 3 wherein said top end of said structure includes a circumferential upwardly opening groove formed therein upwardly through which the upper ends of said anchor bolts extend, said base flange including a downwardly directed circumferential seating lug, said base flange being seated on said top end with said lug snugly seated in said groove and the upper ends of said anchor bolts slidingly received upwardly through a set of circumferentially spaced bores formed in said seating lug and base flange, and tensioning nuts threaded on said upper ends of said anchor bolts above and tightened down on said base flange.

5. The pier foundation of claim 4 including a second set of anchor bolts also imbedded in and extending through said cementitious material, said second set of bolts being spaced radially inwardly of the first mentioned set of bolts, having lower ends anchored to said anchor ring and upper ends projecting upwardly from the top end of said structure and projecting upwardly through said groove, major portions of the length of said second set of anchor bolts between said anchor ring and said top end also being free of connections with said cementitious material, said upper ends of said second set of bolts being slidingly received upwardly through a second set of circumferentially spaced bores formed in said seating lug and base flange and spaced radially inwardly of the first mentioned set of bores, said base flange being carried by the cylindrical lower end of an upright tower, the upper ends of said first mentioned and second set of anchor bolts being disposed outwardly and inwardly, respectively, of said cylindrical lower end.

6. A method of forming, in situ, a tensionless pier foundation and post-compressing the foundation by mounting on the upper end of the foundation a circumferential base flange carried by a hollow cylindrical tower lower end to be supported from said foundation, said base flange including at least one set of circumferentially spaced through bolt holes formed therein, said method comprising excavating a generally circular ground pit of a diameter slightly greater than and a height slightly less than the diameter and height, respectively, of the foundation to be formed, providing substantially concentric and cylindrical outer and inner upstanding pipes within said ground pit, partially back filling said pit exteriorly of said outer pipe and interiorly of said inner pipe, placing a cylindrical skeletal frame within said pit between said outer and inner pipes with said frame including a lower anchor ring spaced adjacent and above the lower ends of said pipes, at least one set of circumferentially spaced, upstanding tensioning bolts having their lower ends anchored relative to said ring and an upper ring removably secured relative to the upper ends of said bolts and stationarily suspended from the upper end of at least one of said pipes and the ground exteriorly of said outer pipe with said upper ring generally horizontally flush with the upper end of said one pipe and lower ring laterally stabilized relative to a first of said pipes, pouring concrete in the annular space between said pipes to a level generally flush with the upper ends of said pipes and below the upper ends of said bolts with substantially all of said bolts shielded against bonding of said concrete thereto, allowing said concrete to harden, removing said upper ring, completing backfill exteriorly of said outer pipe and interiorly of said inner pipe, placing said tower lower end on said foundation with the upper ends of said bolts received through said bolt holes, threading nuts on said bolts above said base flange and thereafter torquing said nuts on said bolts upper ends downwardly onto said base flange to a predetermined torque value.

7. The method of claim 6 wherein said inner and outer pipes are longitudinally corrugated.

8. A tensionless pier foundation including a hollow, upright cylindrical structure of cementitious material including open upper and lower ends, at least one set of upright, circumferentially spaced tension bolts imbedded in and spaced about said cylindrical structure with lower ends of said bolts anchored to an annular anchor structure embedded in and extending about a lower portion of said cylindrical structure and threaded upper ends projecting upwardly from said upper end, said bolts being substantially shielded against bonding of said concrete thereto, a heavy base flange seated tightly upon said upper end of said cylindrical structure and having circumferentially spaced openings formed therethrough through which said threaded upper ends are slidingly received, and a plurality of nuts threaded on said threaded upper ends and tightened downwardly upon said heavy ring sufficiently to place said bolts under heavy tension and thus said cylindrical structure under heavy post-compression fully about said cylindrical structure.

9. The tensionless pier foundation of claim 8 wherein said cylindrical structure includes longitudinally corrugated inner and outer surfaces conforming to and tightly bound by cylindrical inner and outer metal corrugated pipes.

10. A tensionless pier foundation including an upright structure of cementitious material including upper and lower ends, at least one set of upright tension bolts disposed in said upright structure and spaced about a central axis thereof, said bolts including lower ends anchored to an anchor structure embedded in a lower portion of said upright structure and threaded upper ends projecting upwardly from said upper end, said bolts being shielded against bonding of said cementitious material thereto, a heavy base flange seated tightly upon said upper end of said upright structure and having openings formed therethrough through which said threaded upper ends are slidingly received, and a plurality of nuts threaded on said threaded upper ends and tightened downwardly upon said heavy base flange sufficiently to place said bolts under heavy tension, whereby said heavy base flange and anchor structure distribute the heavy tensional forces of said bolts throughout said upright structure between said heavy base flange and said anchor structure to thereby place all of said upright structure, above said anchor structure, under heavy post-compression.

11. The tensionless pier foundation of claim 10 including a tower having a lower end, said tower lower end including at least a portion thereof anchored to said heavy base flange, said tower being subject to predetermined maximum lateral upset forces operable, throughout the height of said tower, to exert a predetermined maximum upward force on said lower end portion, said post-compression being in excess of said upward force.

12. A method of pouring a foundation preparatory to mounting a structure base on said foundation at a first precise level and in predetermined oriented position and wherein said structure base includes a base mounting flange of predetermined plan shape and equipped with first upstanding anchor bolt receiving openings formed therethrough spaced along a perimeter path of said plan shape, said method including providing a template of said plan shape having second upstanding upper bolt receiving openings formed therethrough corresponding to said first openings and equipped with upstanding tensioning bolts having their upper ends adjustably secured through said second openings by upper threaded nuts on said upper ends above said template and lower threaded nuts on some of said bolts below said template, providing support means suspending said template at a second precise level and in oriented position slightly lower than said first position, providing blockout bodies around said some bolts and said lower threaded nuts below said template, pouring said foundation about said bolts and to a level at least slightly above said first level, allowing said foundation to harden, removing said upper nuts, removing said template to thereby leave a groove in the upper surface of said foundation upwardly from which the upper ends of said bolts project, removing said blockout bodies, downwardly threading said lower nuts on said bolts, placing a high compression hardenable grout in said groove, placing said structure base on said foundation with said base mounting flange received in said groove and said bolt upper ends received through said first openings, threading said upper nuts on the upper ends of said bolts above said mounting flange and lightly tightening said upper nuts downwardly upon said base mounting flange, allowing said grout to harden, and thereafter torquing said upper nuts downward along said bolts and against said base mounting flange.

13. A method of pouring a foundation preparatory to mounting a structure base on said foundation at a first precise level and in predetermined oriented position and wherein said structure base includes a base mounting flange of predetermined plan shape and equipped with first upstanding anchor bolt receiving openings formed therethrough spaced along a perimeter path of said plan shape, said method including providing a template of said plan shape having second upstanding upper bolt receiving openings formed therethrough corresponding to said first openings and equipped with upstanding tensioning bolts having their upper ends adjustably secured through said second openings by upper threaded nuts on said upper ends above said template and lower threaded nuts on some of said bolts below said template, providing support means suspending said template at a second precise level and in oriented position slightly lower than said first position, providing blockout bodies around said some bolts and said lower threaded nuts below said template, pouring said foundation about said bolts and to a level at least slightly above said first level, allowing said foundation to harden, removing said upper nuts, removing said template to thereby leave a groove in the upper surface of said foundation upwardly from which the upper ends of said bolts project, determining the amount said groove is tilted relative to a desired plane of said mounting flange, removing said blockout bodies and adjusting said lower threaded nuts, on substantially all of said bolts, in order to position the upper surfaces of substantially all of said lower nuts in said desired plane, placing a high compression hardenable grout in said groove, placing said structure base on said foundation with said base mounting flange received in said groove and supported from said upper surfaces and with said bolt upper ends received through said first openings, threading said upper nuts on the upper ends of said bolts above said mounting flange and lightly tightening said upper nuts downwardly upon said base mounting flange, allowing said grout to harden, and thereafter torquing said upper nuts downward along said bolts and against said base mounting flange.

* * * * *